United States Patent [19]

Carthew

[11] 4,255,132

[45] Mar. 10, 1981

[54] INCINERATOR-HEATER SYSTEM

[75] Inventor: Maximilian K. Carthew, Troy, Mich.

[73] Assignee: Schweitzer Industrial Corp., Madison Heights, Mich.

[21] Appl. No.: 74,645

[22] Filed: Sep. 12, 1979

[51] Int. Cl.[3] ..... F26D 7/04; F27B 9/04

[52] U.S. Cl. ..... 432/21; 432/2; 432/23; 432/29; 432/48; 432/72

[58] Field of Search ..... 432/2, 21, 23, 29, 48, 432/72

[56] References Cited

U.S. PATENT DOCUMENTS

| | | | |
|---|---|---|---|
| 3,627,290 | 12/1971 | Grieve | 432/72 |
| 3,917,444 | 11/1975 | Carthew | 432/72 |
| 3,947,235 | 3/1976 | Bornert | 432/72 |

*Primary Examiner*—John J. Camby

*Attorney, Agent, or Firm*—Krass & Young

[57] ABSTRACT

A high efficiency system and method for supplying heat energy to a combustible effluent producing primary process, such as to a paint drying oven, in which the output of an incinerator-heater is controlled in order to be matched to the heat energy requirements of the process. At the same time, the incinerator burner temperature is sufficiently high to incinerate the combustible effluent developed by the primary process. Effluent laden air is circulated from the process site through a preheat heat exchanger into which is transferred a portion of the heat of the incinerated air prior to entry into the incinerator chamber. The incinerated air is recirculated to the process site in order to provide the heat energy requirements of the drying oven or other process. A proportion of the incinerated air is vented to an exhaust stack via an air-to-air heat exchanger which preheats incoming fresh air circulated to the process site to make up the vented flow of incinerated air. A temperature controller modulates the incinerator burner temperature, as well as the action of a bypass damper causing controlled bypassing of the preheat heat exchanger by the effluent laden air in order to match the heat output of the system to the requirements of the process.

13 Claims, 1 Drawing Figure

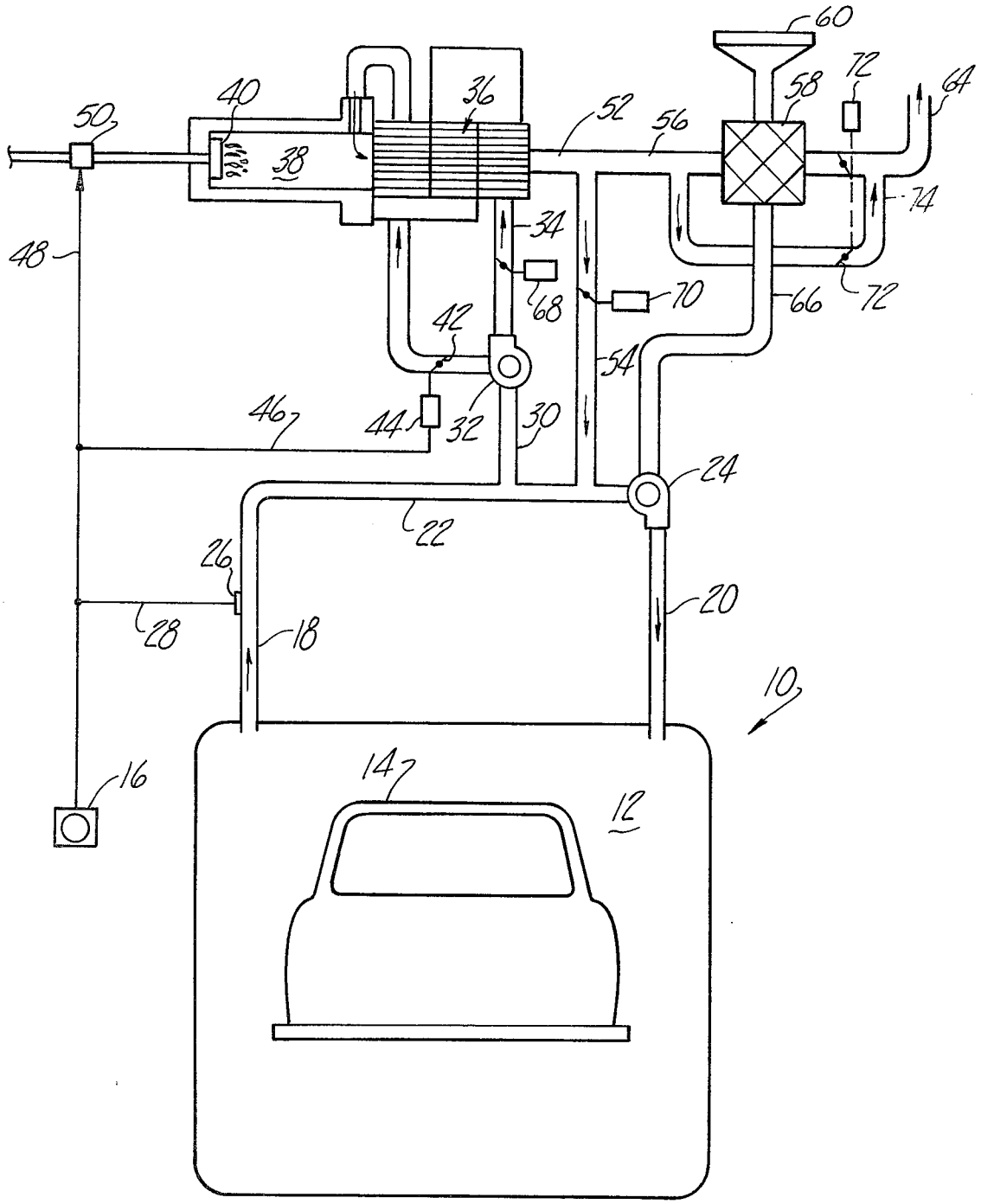
60
72
64
58
40
36
52
56
50
38
74
34
48
68
70
66
72
42
54
46
44
32
30
24
22
26
20
28
18
10
16
14
12

INCINERATOR-HEATER SYSTEM

BACKGROUND DISCUSSION

Many industrial processes generate combustible effluents as a byproduct of the process, and commonly such processes are those which require heat energy in order to be carried out, as for example, in paint enamel drying ovens in which the ambient air is heated to a high temperature to bake the paint which drives off the solvents which are typically of a combustible hydrocarbon base.

The discharge of such effluents directly into the atmosphere has been severely limited by governmental regulation in recent years, such that such effluents must be removed or otherwise eliminated from the air exhausted to the atmosphere.

It has heretofore been known to those skilled in the art that an effective method of eliminating such combustible vapors or effluents is to incinerate the same in a high temperature incinerator. For example, the air exhausted from the paint drying oven passes into an incinerator, which heats the air to a sufficiently high temperature to cause substantially complete combustion of the hydrocarbon vapors into relatively harmless carbon dioxide and water vapor. This process is also effective for removing relatively lightweight solids such as resin particles entrained in the exhaust air stream.

While effective, such processes have basically required substantial additional heat energy to be expended in the system, which raises the overall energy requirements of the particular process.

It has been known that the energy created by burning of the hydrocarbons or other effluents can be reduced by the preheating of the air to be incinerated through a heat exchanger, which heat exchanger also receives the products of combustion such as to transfer a portion of the heat energy of the incineration process into the incoming air to thereby reduce the energy requirements of the incinerator.

A further arrangement for improving the overall efficiency of the process is to pass the incoming fresh air supply through a heat exchanger for which the products of combustion of incinerated air are passed in order to preheat the fresh air supply to reduce the energy requirements for the process.

U.S. Pat. No. 3,917,444, issued to the present inventor, describes various such systems in this context and in which the waste heat generated is utilized in the primary process by recirculation of a portion of the products of combustion to the process, or is used to heat air circulated to the process by a heat exchanger. However, primary heat supplying burners are employed.

While such improvements in efficiency have enhanced the feasibility of this particular approach in eliminating combustible effluents, the overall efficiency is still relatively low and the energy requirements for the process have not substantially been reduced by the utilization of the incinerator heat energy, particularly for applications whereat the effluent level is relatively low.

Accordingly, it is an object of the present invention to provide an improved system and process for incinerating combustible effluents generated in a primary process such as in a paint drying oven, in which high efficiency utilization of the heat energy generated in the incinerator in the primary process is achieved.

It is a further object of the present invention to provide such efficiency system which employs a minimum number of components and which is reliable and trouble free in operation.

SUMMARY OF THE INVENTION

These and other objects of the present invention, which will become apparent upon a reading of the following specification and claims, are achieved by the arrangement in which an incinerator is utilized as the heat energy source for the primary process and which is modulated with the varying requirements of heat energy required in the primary process.

This modulation range, however, is selected to be above the temperature level required for incineration of the combustible effluents. Thus, the incineration is provided as a byproduct incidentally to providing heat energy in the primary process such that the incinerator consumes a minimum of energy in carrying out incineration.

This particular arrangement includes an incineration burner chamber into which is introduced the air circulated from the process site, i.e., as from a paint drying oven, after having passed through a preheat heat exchanger which preheats the incoming effluent bearing air, by passing the incinerated air therethrough.

Thence, it passes into the incinerator combustion chamber which further heats the air to the temperature of combustion of the effluents.

The incinerated air then passes through the preheat heat exchanger and a portion of which is then redirected to the primary process site, i.e., into a paint drying oven.

A proportion of the incinerated air may be vented to the atmosphere through an air supply heat exchanger, which is heated by the vented incinerated air, to cause preheating of an incoming fresh air flow, which is added to the system in order to provide a make up flow for vented incinerated air.

The air-to-air heat exchanger is here feasible, since the tendency to clog due to the presence of particulates in the exhaust is obviated by their incineration prior to entering the exchanger.

The incinerator burner temperature is modulated in accordance with the primary process heat energy requirements to increase or decrease the heat energy generated in the incinerator as per the primary process heat energy requirements, but through a sufficiently high temperature range to insure substantially complete incineration, as for example, between 1200° and 1500° F.

A further controlled heat energy modulation is achieved by the use of bypass dampers which bypass the air received circulated from the paint drying ovens through the preheat exchanger to reduce the degree of preheat prior to entering into the incinerator combustion chamber.

A bypass damper system is also provided for shutdown operation and circulation of the air without passing through the incinerator and for bypassing the air supply heat exchanger for rapid cool down.

DESCRIPTION OF THE DRAWINGS

The FIGURE is a diagrammatic representation of the system and method according to the present invention depicting a paint drying oven as the primary process to which the system and incinerator method are applied.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

As noted, there is provided in the prior art approaches an incinerator burner and separate process heat make up burner with relatively minor heat recovery from the incinerator. This is contrasted with the present invention, as depicted in the FIGURE, which arrangement provides a single incinerator-heater for each process zone from which the process heat requirements for each zone are completely derived. That is, the incinerator-heater generates the necessary heat for the primary process zone.

The arrangement for achieving this end includes circulation of the effluent laden air from the primary process site into the incinerator combustion chamber, wherein the air is heated to a temperature sufficiently high to incinerate the combustible effluent. The incinerated air is then circulated back to the primary process site, such that its heat energy is directly made available for maintaining the temperature conditions necessary for the primary process, such as in the paint drying oven interior.

Referring to the FIGURE, a paint drying oven zone 10 is depicted, as utilizing the incinerator-heater according to the present invention and includes an enclosure 12 within which paint drying operations are conducted as on auto body shells or other components indicated at 14. It will be appreciated by those skilled in the art that a number of zones may be incorporated in a given oven installation, each of which may be provided with a separate incinerator-heater to supply the zone heating requirements. Broadly, each zone would be a "primary process site".

A temperature sensor 26 and controller 16 are provided which monitors the temperature condition within the enclosure 12 generating corresponding electrical signals as by thermocouples and providing control system error signals for a temperature control system. Temperature sensor 26 is connected by a branch line 28 to branch line 48 connecting the controller 16 to the burner control gas line 50 as will be described.

The air is circulated from the oven zone enclosure through an outlet ducting 18 for elimination of the combustible effluents, as well as to enable the addition of heat energy by the system according to the present invention, and thence returned to the interior through a return duct 20.

The air is circulated through a cross duct 22 by means of a supply blower 24.

A portion of the air circulated through the cross duct 22 is withdrawn through an exhaust duct 30 by an exhaust fan 32. The exhaust air flow, laden with the combustible effluent, passes through a duct 34 into a conventional air-to-air preheat heat exchanger 36 through which is directed the air flow prior to entering into the incinerator chamber 38. The preheat heat exchanger 36 comprises a heat exchanger means for producing a heat transfer between the incoming exhaust air via duct 34 and the outgoing incinerated air exiting the incinerator chamber 38 after incinerated, to cause the heat generated in the incinerator to serve to preheat the incoming air to a relatively elevated temperature. For example, the air for typical applications to a paint drying oven will enter the preheat heat exchange 36 at 350° F. and be heated to a temperature on the order of 1150° F., and thereafter raised to incineration temperature by operation of the incinerator burner 40.

The incinerator burner 40 is of a type which is commercially available and serves to provide a high temperature flame front of sufficient turbulence, temperature and dwell time to insure substantially complete combustion of the effluent into carbon dioxide and water vapor.

A bypass damper indicated at 42 is also provided which modulates the bypass of the circulated effluent laden air directly into the incinerator chamber 38 under the control of a damper controller 44, which in turn is positioned as indicated by the branch line 46, in response to signals from the temperature control system. That is, the degree of preheat is modulated with the varying requirements of the primary process, i.e., the heating requirements needed for the paint drying oven 10.

The primary control is provided through branch line 48 controlling the gas valve 50 which in turn controls the heat output of the incinerator burner 40.

According to the concept of the present invention as outlined above, the temperature within operation of the incinerator burner 40 is modulated with a range of approximately 1200° to 1500° F. for this application, over which range the varying heat requirement of the primary process can be met while insuring complete incineration of the effluent gases, in the incinerator chamber 38 at temperatures throughout the range.

The incinerated air, which is at a relatively elevated temperature, passes through the preheat heat exchanger 36, gives up a portion of its heat to the incoming circulated air and thence is directed outwardly to the incinerator outlet duct 52 where it is directed via branch duct 54 into the cross duct 22 and thence to be redirected into the paint drying oven 12 interior. Thus, the main heat energy generated by the incinerator is directly applied to the heat energy requirements of the paint drying oven zone 10.

A proportion of the incinerated air is vented through vent duct 56, which passes through an air-to-air heat exchanger 58 prior to being vented to the vent roof stack 64. The fresh air supply is drawn in through a filter 60 and thence through the air-to-air heat exchanger 58 to be preheated by the relatively hot incinerated air flowing through vent duct 56 and thence returning into supply fan inlet duct 66 to be recirculated together with the incinerated air into the interior of the oven.

It is noted that a major benefit is derived from incinerating the air prior to entering the heat exchanger 58 in that clogging of the exchanger air passage with paint solids is thereby avoided.

For this application, approximately 15% of the air flow through the return duct 20 will be incinerated air and 5% will be make up fresh air from the exterior which has been preheated.

A control damper system with dampers 68, 70 and 72 is provided for cooling turndown, during which the heat energy recovery systems are rendered nonoperational and air is merely recirculated and fresh air drawn in by the supply blower 24. Bypass ducting 74 receives the exhaust flow under these conditions.

Accordingly, it can be seen that a very high efficiency process is provided by this arrangement since the incinerator itself functions as the primary heat source for the primary process and thus its heat is not wasted and is utilized to a maximum. The incinerated air is returned directly to the paint drying oven zone 10 in order to directly return the energy associated with the pollution control incineration rather than a reliance on secondary heat energy recovery systems.

The partial exhausting of the incinerated air is offset by the air-to-air heat exchanger 58 and the preheating of the effluent carrying air in the preheat heat exchanger 36. Thus, the incinerator functions a dual role under the control of the temperature control system to eliminate the large waste associated with the separate incinerator and make up burners as per prior art practices.

All of the components are conventional and are commercially available or of known construction per se and may be purchased or fabricated at relatively modest cost. These components are known to operate reliably and are field proven such that the overall system may operate reliable and effectively.

The embodiments of the invention in which an exclusive property or privilege is claimed are defined as follows:

1. An incinerator-heater system for a heat energy requiring primary process, which process develops combustible effluent contained in an air mass at the process site, which air is required to be heated for execution of the primary process, the system comprising:

an incinerator-heater burner, and combustion chamber housing said burner, and means for circulating air to and from said site of said primary process with said air from said site of said primary process containing said combustible effluent;

means for recirculating at least a portion of said air flow from said site of said primary process into said combustion chamber;

means for incinerating said effluent in said combustion chamber;

means for returning at least a portion of said incinerated air to said incinerator process site;

means for modulating said incinerator burner operation through a predetermined range of temperature levels in said combustion chamber in accordance with the heat energy requirements of said primary process, said predetermined range of temperature levels being above the level required to incinerate said combustible effluent contained in said air flow from said site of said primary process;

whereby said incinerator-heater burner operates as the heat energy source for said primary process.

2. The system according to claim 1 further including heat exchanger means receiving at least a portion of said air flow from said site of said primary process prior to entry into said combustion chamber, wherein said incinerated air passes through said heat exchanger means and creates a heat transfer relationship therebetween, whereby said incoming effluent carrying air is preheated prior to entry into said combustion chamber.

3. The system according to claim 1 further including means for venting a portion of said incinerated air to the atmopshere after passing out through said combustion chamber and further including means for drawing a flow of make up fresh air to said primary process site in correspondence with said volume of vented incinerated air.

4. The system according to claim 3 further including an air-to-air heat exchanger receiving said vented incinerated air flow from one side thereof receiving said fresh air flow, whereby said fresh air is preheated by a heat transfer relationship between said vented incinerated air and said incoming fresh air, and said incinerated air is substantially free of combustible solids prior to entering said heat exchanger to thereby avoid clogging thereof.

5. The system according to claim 2 further including bypass ducting means controllably bypassing a proportion of said air flow through said heat exchanger means from said primary process site; and, further including means controlling said proportion of bypass in accordance with the energy requirements of said primary process, whereby said energy requirements of said primary process may be met by modulation of said incinerator-heater burner operation and by said degree of bypass through said heat exchanger means.

6. The system according to Claim 1 wherein said means controlling said burner operation comprises a temperature sensor located at the primary process site and means responsive to variation in said temperature sensed to control operation of said incinerator-heater burner, and wherein said range of temperature levels is on the order of 1200° F.–1500° F.

7. The system according to claim 1 wherein said primary process comprises a paint drying oven wherein air is circulated through said interior of said paint drying oven by blower means and inlet and return duct means, and wherein a portion of said circulated air comprises said portion of air withdrawn passed into said combustion chamber.

8. The method of applying heat energy to a heat utilizing primary process and incinerating combustible effluent developed in said process and passed into the air at the site of said primary process, the steps comprising:

withdrawing a portion of said recirculated air carrying effluent byproducts;

directing said air flow into an incinerator burner combustion chamber;

operating said burner at a temperature level sufficient to incinerate said combustible effluent;

returning at least a portion of said incinerator air to said site of said primary process; and, modulating the burner operation to provide a variable degree of heat output sufficient for the energy requirement of said primary process through a range of temperature levels in said combustion chamber, said range of temperature levels being above the level required to provide incineration of said combustible effluent;

whereby said incinerator burner operation provides both the heat energy requirements of the primary process and incineration of said combustible effluent thereof.

9. The method according to claim 8 further including the steps of establishing an air-to-air heat exchange relationship between said effluent bearing air and said incinerated air after passing through said combustion chamber.

10. The method according to claim 9 further including the steps of venting a portion of the incinerated air to vent while returning the remaining portion to the site of said primary process.

11. The method according to claim 10 further including the step of establishing a heat transfer relationship between said portion of said incinerated air exhausted to vent and incoming make up fresh air supply.

12. The method according to claim 10 further including the step of modulating said heat transfer relationship between said effluent bearing air and said incinerated air in accordance with the varying energy requirements of said primary process.

13. The method according to claim 8 wherein said temperature range is on the order of 1200° F.–1500° F.

* * * * *